US006880540B2

(12) United States Patent
Fuma et al.

(10) Patent No.: US 6,880,540 B2
(45) Date of Patent: Apr. 19, 2005

(54) IGNITION COIL, AND INTERNAL COMBUSTION ENGINE IGNITION DEVICE

(75) Inventors: Tomohiro Fuma, Ichinomiya (JP); Hiroshi Inagaki, Kounan (JP); Takahiro Suzuki, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 10/483,559

(22) PCT Filed: Jul. 17, 2002

(86) PCT No.: PCT/JP02/07276

§ 371 (c)(1),
(2), (4) Date: Jan. 13, 2004

(87) PCT Pub. No.: WO03/008799

PCT Pub. Date: Jan. 30, 2003

(65) Prior Publication Data

US 2004/0173194 A1 Sep. 9, 2004

(30) Foreign Application Priority Data

Jul. 18, 2001 (JP) ..... 2001-217866

(51) Int. Cl.[7] ..... F02P 1/00

(52) U.S. Cl. ..... 123/634; 123/169 PA; 324/399

(58) Field of Search ..... 123/634, 635, 123/143 C, 169 PA, 169 PH; 324/399

(56) References Cited

U.S. PATENT DOCUMENTS 6,215,385 B1 * 4/2001 Ogden ..... 336/96
6,463,919 B1 * 10/2002 Skinner et al. ..... 123/634
6,571,784 B1 * 6/2003 Shimada et al. ..... 123/634
6,781,500 B1 * 8/2004 Kawai et al. ..... 336/198

FOREIGN PATENT DOCUMENTS

| | | | |
|---|---|---|---|
| EP | 1061352 | A2 | 12/2000 |
| JP | 2-230965 | A | 9/1990 |
| JP | 11-247751 | A | 9/1999 |

* cited by examiner

*Primary Examiner*—John T. Kwon
(74) *Attorney, Agent, or Firm*—Morgan, Lewis & Bockius LLP

(57) ABSTRACT

An object of the present invention is to provide an ignition coil which has a structure to make it possible to connect the ignition coil to a spark plug directly and in which an installation space need not be changed largely when the ignition coil is mounted in a cylinder head, and an internal combustion engine ignition system having the ignition coil.

In the present invention, a protection metal pipe (31) of an ignition coil (9) is formed so that a rear end side portion of a spark plug (11) in the rear of a rear end surface (23*b*) of a collar portion (23) in a metal shell (19) can be received in the inside of the protection metal pipe (31) from a front end (31*b*). The ignition coil (9) has a structure in which the ignition coil (9) is directly connected to the spark plug (11). The protection metal pipe (31) of the ignition coil (9) is formed to serve also as a plughole pipe, so that the outer diameter of the protection metal pipe (31) can be enlarged up to the outer diameter of a conventional plughole pipe. As a result, a space for installing a coil body portion (37) can be secured largely in the inside of the protection metal pipe (31), so that the installation space need not be changed largely when the ignition coil is mounted in a cylinder head.

10 Claims, 9 Drawing Sheets

IGNITION COIL, AND INTERNAL COMBUSTION ENGINE IGNITION DEVICE

TECHNICAL FIELD

The present invention relates to an ignition coil for generating an ignition voltage to be applied to a spark plug attached to each cylinder of an internal combustion engine and an internal combustion engine ignition system having the ignition coil for generating a spark discharge to ignite an air-fuel mixture.

BACKGROUND ART

Conventionally, an internal combustion engine ignition system for igniting an air-fuel mixture in an internal combustion engine used as an automobile engine or the like is formed to include an ignition coil for generating an ignition voltage, and a spark plug for generating a spark discharge by the ignition voltage applied to the spark plug.

Generally, the ignition coil includes a coil body portion having a primary winding, a secondary winding, and a coil core for magnetically coupling the two windings. The ignition coil is configured so that an ignition voltage is generated between opposite ends of the secondary winding by variation in the magnetic flux density of the coil core in accordance with the conduction/interruption of a current flowing in the primary winding. The ignition coil is electrically connected to the spark plug through a wiring cable (current-conduction path) such as a high tension cable or the like, so that the ignition coil applies the ignition voltage to the spark plug.

Incidentally, an intake/exhaust valve drive mechanism having a cam shaft or the like for driving an intake valve and an exhaust valve is provided in an internal space formed between an upper portion of a cylinder head having the spark plug fixed thereto and a cylinder head cover. Lubricating oil for operating the intake/exhaust valve drive mechanism smoothly is circulated.

On the other hand, the spark plug has a structure in which a spark discharge is generated by application of a high voltage. If lubricating oil is deposed on the spark plug, there is a possibility that the spark discharge cannot be generated normally because of influence of electrical leakage or the like. Therefore, a cylindrical plughole pipe formed to have an inner diameter enough for the spark plug to pass through is provided in the internal space formed between the cylinder head and the cylinder head cover to thereby secure the installation space of the spark plug and isolate the spark plug from the lubricating oil. Incidentally, the plughole pipe is fixed to the cylinder head in a state in which the axial direction of the plughole pipe becomes one and the same as the axial direction of the spark plug.

After the spark plug is mounted in the installation space formed by the plughole pipe, the aforementioned wiring cable is wired between the ignition coil and the spark plug to thereby electrically connect the ignition coil and the spark plug to each other.

When the ignition coil and the spark plug are connected to each other through the wiring cable such as a high tension cable or the like, there is however a problem that as the distance between the ignition coil and the spark plug increases, the resistance value of the wiring cable increases and the loss in the wiring cable increases because of the influence of external noise or the like. When the loss in the wiring cable becomes high in this manner, energy for generating the ignition voltage is wastefully consumed by the wiring cable. In some cases, there is fear that the spark discharge may not be generated because of shortage of the voltage value applied to the spark plug.

Use of a structure (so-called direct ignition type plug) in which the ignition coil and the spark plug are directly connected to each other is effective in solving the problem. In order to use this structure, it is however necessary to secure the installation space of the ignition coil in the internal space formed between the cylinder head and the cylinder head cover. Because the intake/exhaust valve drive mechanism or the like as well as the spark plug is provided in the internal space formed between the cylinder head and the cylinder head cover as described above, it cannot be said that securement of the installation space for installing the ignition coil in the cylinder head is easy.

Therefore, an object of the present invention is to provide an ignition coil which has a structure to make it possible to connect the ignition coil to a spark plug directly and in which an installation space need not be changed largely when the ignition coil is mounted in a cylinder head, and to provide an internal combustion engine ignition system having the ignition coil.

DISCLOSURE OF THE INVENTION

The invention described in claim 1 to achieve the foregoing object provides an ignition coil comprising: a coil body portion including a primary winding, a secondary winding wound so as to concentric with the primary winding, and a coil core; and a cylindrical protection metal pipe for protecting the coil body portion by receiving the coil body portion in its own inside; characterized in that the protection metal pipe is formed as a plughole pipe fixed to a cylinder head.

Because the ignition coil has the protection metal pipe formed as a plughole pipe, that is, formed to serve also as a plughole pipe, it is unnecessary to provide any plughole pipe in the cylinder head separately when the ignition coil is installed in the cylinder head. For this reason, the number of parts constituting the internal combustion engine ignition system can be reduced. Moreover, when the ignition coil is used, the outer diameter of the plughole pipe can be reduced compared with the case where the protection metal pipe of the ignition coil and the plughole pipe are provided separately. The region occupied by the ignition coil in the cylinder head can be made smaller than the conventional region, so that a space for installing other equipment such an intake/exhaust valve mechanism, etc., can be secured widely. Or a space for the coil body portion can be secured largely because it is unnecessary to provide any protection metal pipe separately as in the conventional case even if the outer and inner diameters of the conventional plughole pipe are not changed. As a result, the number of turn times in the primary winding or in the secondary winding can be increased to improve the capacity of the ignition coil itself or the reliability of insulation can be improved.

In this manner, the coil body portion including the primary winding, the secondary winding and the coil core is received in the inside of the protection metal pipe formed as a plughole pipe. Accordingly, the installation space for installing the ignition coil can be secured effectively in the internal space formed between the cylinder head and the cylinder head cover. Accordingly, a structure (so-called direct ignition type plug) in which the ignition coil and the spark plug are directly connected to each other without interposition of any wiring cable can be attained for performing connection (inclusive of electrical connection) to the spark plugmounted in the cylinder head. Incidentally, because the protection metal pipe of the ignition coil serves also as a plughole pipe, the function of isolating the spark plug from lubricating oil of the internal combustion engine can be fulfilled when the protection metal pipe is fixed into the cylinder head while the ignition coil and the spark plug are directly connected to each other.

Moreover, because the protection metal pipe of the ignition coil is formed as a plughole pipe, an operation of mounting the ignition coil itself (coil body portion) and an operation of mounting the plughole pipe can be performed simultaneously when the ignition coil is mounted in the cylinder head. Accordingly, the number of man-hour can be simplified.

Hence, the ignition coil of the present invention can be directly connected to the spark plug, so that the loss of the ignition voltage applied to the spark plug can be reduced and, accordingly, occurrence of misfire can be prevented. Moreover, when the protection metal pipe of the ignition coil is formed as a plughole pipe, the operation of mounting the ignition coil and the operation of mounting the plughole pipe can be performed simultaneously. Accordingly, the number of man-hours for assembling can be reduced. Moreover, the number of parts can be made smaller than conventional.

Preferably, in the ignition coil described above, the coil body portion and the protection metal pipe formed as a plughole pipe may be integrated with each other so that they cannot rotate around an axis.

Because the coil body portion and the protection metal pipe are integrated with each other so that they cannot rotate around an axis as described above, nonconformity (e.g., torsion of wire connecting the coil body portion to external equipment, etc.) caused by positional displacement between the coil body portion and the protection metal pipe can be avoided even in the case where rotation or the like occurs when the ignition coil is fixed into the cylinder head. Accordingly, the reliability as the ignition coil can be improved. Moreover, because the coil body portion is integrated with the protection metal pipe fixed into the cylinder head, the coil body portion can be held stably even in the case where the internal combustion engine is used.

Incidentally, the method of non-rotatably integrating the coil body portion with the protection metal pipe is not particularly limited. For example, there may be used a method in which an insulating resin is filled in the inside of a hollow protection metal pipe and molded in the condition that the coil body portion is received in the inside of the hollow protection metal pipe. Incidentally, as for integration of the coil body portion and the protection metal pipe with each other, the coil body portion and the protection metal pipe may be integrated with each other through another member (e.g., a ferromagnetic member which will be described later).

Furthermore, because the position of wiring of the coil body portion led out from the protection metal pipe (wiring for connecting the coil body portion to external equipment) can be fixed as a predetermined position when the coil body portion is integrated with the protection metal pipe, the lead-out position of wiring can be set to a specific position when the ignition coil is disposed in a predetermined position relative to the cylinder head in advance.

Incidentally, an insulating resin is generally molded on the coil body portion having the primary winding, the secondary winding and the coil core in order to attain insulation from various kinds of parts. Conventionally, there has been used a structure in which an ignition coil formed in such a manner that the inside of the protection metal pipe is filled with an insulating resin after the coil body portion is disposed in the protection metal pipe is loosely inserted in a plughole pipe mounted in the cylinder head. That is, there has been a structure in which a gap (space) is interposed between the outer surface of the protection metal pipe of the ignition coil and the inner surface of the plughole pipe. For this reason, in the conventional structure, even in the case where heat is released in the primary and secondary windings of the coil body portion due to the current conduction thereto, air existing in the gap functions as an adiabatic layer to disturb radiation of heat from the coil body portion to the outside. When the temperature of the coil body portion is increased by the heat released on the basis of the current conduction, the insulation resistance value of the insulating resin molded on the coil body portion is reduced. As a result, a leakage current as a loss based on the voltage generated in the secondary winding flows in other members (e.g., the primary winding and the coil core). When the worst case happens, there is fear that the coil body portion may be broken.

Therefore, in the ignition coil described above, the inside of the protection metal pipe formed as a plughole pipe may be preferably filled with an insulating material. In the ignition coil having such an insulating material, heat released in the coil body portion can be radiated to the outside through the insulating material and the protection metal pipe because the insulating material functions as a heat-conduction path between the coil body portion and the protection metal pipe. That is, in the present invention, because the protection metal pipe is formed as a plughole pile, the space which is conventionally provided to serve as an adiabatic layer need not be interposed between the plughole pipe and the protection metal pipe. For this reason, heat released in the coil body portion can be directly radiated toward the cylinder head and the cylinder head cover or toward lubricating oil which is deposited on the outer surface of the protection metal pipe (plughole pipe) for operating the intake/exhaust valve mechanism. Because the heat-radiating characteristic of the coil body portion is improved in this manner, a leakage current can be prevented from being caused by greater increase in temperature than necessary. Accordingly, the output voltage value of the coil body portion can be prevented from being reduced, so that lowering of performance of the ignition coil and damage of the ignition coil can be suppressed.

Hence, according to the ignition coil of the present invention, because the insulating material is provided between the coil body portion and the protection metal pipe, improvement in heat-radiating characteristic can be attained. Accordingly, reduction in the output voltage can be prevented, so that lowering of performance as the ignition coil can be suppressed.

Incidentally, for example, the insulating material can be formed of an insulating resin, insulating oil, or the like.

Next, the ignition coil described above may include a position regulating portion for positioning the coil body portion in an axial direction in the inside of the protection metal pipe.

That is, when the position regulating portion is formed so that the coil body portion is disposed in a predetermined position in the axial direction in the inside of the protection metal pipe, the coil body portion can be easily positioned in the inside of the protection metal pipe. Incidentally, the axial direction means a direction of extension of the center axis of the protection metal pipe shaped like a cylinder.

Furthermore, because the protection metal pipe is formed as a plughole pipe, a part of the spark plug is disposed in the inside of the protection metal pipe but the coil body portion and the spark plug can be disposed in an appropriate position (a position in the axial direction) of the inside of the protection metal pipe by the position regulating portion.

Furthermore, because the position regulating portion is provided, the movement of the coil body portion due to the filling pressure of the insulating material can be suppressed effectively when the inside of the protection metal pipe is filled with the insulating material in the condition that the coil body portion is positioned in the axial direction in the inside of the protection metal pipe.

Hence, according to the ignition coil of the present invention, the coil body portion can be positioned in the inside of the protection metal pipe. There is an advantage in that the coil body portion and the spark plug can be disposed in an appropriate position in the inside of the protection metal pipe.

In an internal combustion engine ignition system in which an ignition coil for generating an ignition voltage and a spark plug for generating a spark discharge by application of the ignition voltage from the ignition coil are directly connected to each other so that a spark discharge for igniting an air-fuel mixture is generated in the spark plug.

That is, if the internal combustion engine ignition system is formed to have the ignition coil as described above, reduction in the voltage applied to the spark plug can be prevented, so that misfire can be prevented from occurring.

Furthermore, the operation of mounting the ignition coil and the operation of mounting the plughole pipe can be performed simultaneously when the internal combustion engine ignition system is assembled. Accordingly, the number of man-hours for assembling can be made smaller than conventional, so that the number of parts can be reduced more greatly.

Hence, according to the internal combustion engine ignition system of the present invention, the spark discharge can be generated more surely. Accordingly, the internal combustion engine ignition system can be achieved as an internal combustion engine ignition system in which misfire hardly occurs, so that a stable operating state of the internal combustion engine can be kept. Furthermore, because the number of man-hour for assembling can be made smaller than conventional, suppression of the production cost of the internal combustion engine can be attained.

Incidentally, an internal combustion engine in which the air-fuel ratio in an air-fuel mixture is set to be high (set at a lean air-fuel ratio) to meet the needs of improvement in efficiency and cleanness of the internal combustion engine has been popularized in recent years. In such an internal combustion engine, a structure is intended in consideration of turbulence (swirl flow) of the air-fuel mixture in the combustion chamber, so that an air-fuel mixture suitable to combustion is generated in a neighbor of the spark discharge gap of the spark plug to thereby stabilize ignitability of the air-fuel mixture.

It is however known that the position of the ground electrode of the spark plug disposed in the combustion chamber has influence on the ignitability of the air-fuel mixture in the case where turbulence of the air-fuel mixture is generated. There is a possibility that the ignitability may be lowered according to the position of the ground electrode disposed. That is, though the air-fuel mixture is ignited by contact with the spark discharge generated in the spark discharge gap of the spark plug, the ground electrode may be an obstacle to contact between the air-fuel mixture and the spark discharge, for example, when the ground electrode stands to windward of the spark discharge gap relative to the direction of turbulence of the air-fuel mixture. For this reason, there is fear that the ignitability of the air-fuel mixture may be lowered because of prevention of propagation of a flame.

Specifically, when the angular position θ of the ground electrode X with respect to the direction of flow of the air-fuel mixture (i.e., the angle θ between the ground electrode X and the air-fuel mixture) in the inside of the combustion chamber 55 is set as shown in FIG. 10(*b*), the preferred positional angle θ varies according to the kind of the engine but ignitability is generally made good when the positional angle θ satisfies θ=90°, 270°. On the other hand, in the case of θ=0°, 360° in which the spark discharge gap g is hidden behind the ground electrode X as an obstacle to the flow of the air-fuel mixture, ignitability is lowered. Even in the case of θ=180°, ignitability is slightly lowered because the ground electrode X is located in a position to disturb variable growth. In this manner, the angular position θ of the ground electrode X with respect to the flow of the air-fuel mixture has influence on engine performance (ignitability). Incidentally, FIG. 10(*b*) is equivalent to a view of the spark plug 11 from the combustion chamber 55 side when the spark plug 11 is mounted in the cylinder head 51 as shown in FIG. 10(*a*).

In a spark plug having a structure in which the spark plug is mounted in the cylinder head by thread engagement, the position of the ground electrode disposed in the combustion chamber cannot be decided according to the spark plug, so that it is difficult to dispose the ground electrode in a specific position in the combustion chamber. Furthermore, in the spark plug mounted in the cylinder head by thread engagement, the stop position of the ground electrode at the time of final mounting varies according to slight dimensional error and individual difference in the thread groove. Hence, there is a problem that it is also difficult to dispose the ground electrode in a specific position surely.

Therefore, in the internal combustion engine ignition system described above, the spark plug used may include a center electrode inserted in a front end side of an axial hole of an insulator, a metal shell disposed so as to form a collar portion having a plug bearing surface touching the cylinder head directly or indirectly through another member and so as to surround a radial circumference of the insulator, and a ground electrode coupled to the metal shell so that a spark discharge is generated between the ground electrode and the center electrode, in which the spark plug is fixed to the cylinder head by the protection metal pipe of the ignition coil while the plug bearing surface of the metal shell is pressed against the cylinder head.

The spark plug provided in the internal combustion engine ignition system has a structure in which the spark plug is not mounted in the cylinder head by thread engagement but the spark plug is fixed to the cylinder head by the protection metal pipe of the ignition coil as will be described later. That is, the spark plug can be mounted in the cylinder head (specifically, the plug arrangement hole formed in the cylinder head) while loosely inserted in the cylinder head. Accordingly, the position of a portion of the ground electrode coupled to the metal shell can be easily positioned in the circumferential direction around the axial line of the plug arrangement hole when the spark plug is mounted in the cylinder head. The problem in variation in the position of the ground electrode in the structure in which the spark plug is thread-engaged can be suppressed.

When, for example, the position (target position) of the ground electrode disposed in the combustion chamber is set in advance and the spark plug is inserted and fixed into the cylinder head toward the target position, the position of the ground electrode disposed at the time of final mounting can be set to be the target position. That is, because the direction of flow of the air-fuel mixture in the combustion chamber is determined on the basis of the structure of an air intake pipe and the combustion chamber, the direction relative to the cylinder head is substantially constant. Accordingly, the position of the ground electrode disposed may be set in consideration of the direction of flow of the air-fuel mixture at the time of mounting the spark plug. Furthermore, it is unnecessary to form a thread groove in the plug arrangement hole as in the conventional case. Accordingly, the inner diameter of the plug arrangement hole can be reduced by at least the thickness of the thread groove, so that large-area intake/exhaust valves can be easily installed on the cylinder head side. There is also an advantage in that it is easy to provide a design for installing those valves.

Furthermore, the notable point in the internal combustion engine ignition system is that when the spark plug having the metal shell having no thread groove in its outer circumference needs to be fixed to the cylinder head, the protection metal pipe of the ignition coil functioning also as a plughole pipe is used for pressing the plug bearing surface of the metal shell against the cylinder head to thereby fix the spark plug.

That is, in the present invention, the plughole pipe for isolating the spark plug from lubricating oil is used as a protection metal pipe of the ignition coil and also as a fixing member for fixing the spark plug to the cylinder head. Because the protection metal pipe of the ignition coil mounted in the cylinder head is used as a fixing member for fixing the spark plug to the cylinder head in this manner, increase in the number of parts can be reduced compared with the case where a fixing member for fixing the spark plug is added newly.

Furthermore, because the protection metal pipe of the ignition coil is formed as a plughole pipe, the operation of mounting the ignition coil and the operation of mounting the plughole pipe can be performed simultaneously when the protection metal pipe is mounted in the cylinder head.

When the spark plug having the metal shell having no thread groove is fixed to the cylinder head, it is important that the difference from the conventional structure of thread-engaging the spark plug with the cylinder head is in that the spark plug is fixed to the cylinder head stably even in the case where combustion pressure is applied from the combustion chamber side or even in the case where vibration occurs largely in the internal combustion engine. Therefore, in the present invention, the plug bearing surface of the metal shell is pressed against the cylinder head by the protection metal pipe of the ignition coil. As a result, the nearly whole of the plug bearing surface of the collar portion of the metal shell is pressed uniformly, so that the plug bearing surface can be brought into contact with the cylinder head stably. Accordingly, the spark plug can be fixed stably even in the case where combustion pressure is applied from the combustion chamber side. Incidentally, the plug bearing surface of the metal shell may be preferably pressed by a pressing force larger than the combustion pressure generated by combustion of the air-fuel mixture, specifically by a pressure of not smaller than 10 [MPa] so that the spark plug can be fixed to the cylinder head stably by the protection metal pipe of the ignition coil.

Hence, according to the internal combustion engine ignition system of the present invention, because the spark plug is fixed to the cylinder head in the condition that the plug bearing surface of the metal shell is pressed against the cylinder head by the protection metal pipe of the ignition coil functioning also as a plughole pipe, the spark plug having the metal shell having no thread groove can be fixed to the cylinder head stably without use of any new fixing member.

Incidentally, the protection metal pipe of the ignition coil functioning also as a plughole pipe may be preferably pressed while abutting on a part of the metal shell in order to fix the plughole pipe to the cylinder head so that the plug bearing surface of the metal shell can be pressed against the cylinder head. Specifically, the protection metal pipe of the ignition coil may be preferably fixed to the cylinder head while abutting on the rear end surface which is in the collar portion of the metal shell in the spark plug and which is located on a side opposite to the plug bearing surface, so that the plug bearing surface can be pressed against the cylinder head. When a caulked portion obtained by caulking the circumferential edge of the rear end portion of the metal shell itself toward the outer circumferential portion of the insulator is formed in the metal shell, the protection metal pipe of the ignition coil may be fixed to the cylinder head while abutting on the caulked portion to thereby press the plug bearing surface against the cylinder head.

Incidentally, a method of detecting an ionic current is known as a method for detecting misfire, knocking, etc. in the internal combustion engine. For example, detection of the ionic current is carried out in such a manner that a current flowing in a closed loop formed by the secondary winding and the spark plug is detected in the condition that a detection voltage reverse in polarity to the ignition voltage is applied to the spark plug. Because the detection voltage is applied to the spark plug through a current-conduction path connecting the ignition coil and the spark plug, there is fear that the ionic current cannot be detected accurately if the resistance value of the current-conduction path becomes large when the ionic current is to be detected by using the current-conduction path. This is because the ionic current is a minute electric current so that slight variation in the resistance value of the current-conduction path has large influence on detection accuracy.

Therefore, the internal combustion engine ignition system described above may further comprise ionic current detection means for detecting an ionic current flowing in a closed loop formed by the spark plug and the secondary winding after combustion of an air-fuel mixture.

That is, in the internal combustion engine ignition system described above, the ignition coil in a state in which the protection metal pipe (plughole pipe) and the coil body portion are integrated with each other is directly connected to the spark plug without interposition of any wiring cable. For this reason, the distance between the terminal electrode electrically connected to the center electrode of the spark plug and the high voltage output terminal electrically connected to the secondary winding of the ignition coil is shortened so that contact characteristic between the terminal electrode and the high voltage output terminal is made good. Accordingly, lowering of accuracy in detection of the ionic current can be suppressed, so that the ionic current can be detected accurately.

BRIEF DESCRIPTION OF THE DRAWINGS

FIG. 1(*b*) is a sectional view of the cylinder head and the cylinder head cover after the ignition coil and the spark plug are mounted;

FIG. 2(*b*) is a schematic sectional view of a coil body portion and a ferromagnetic member; and FIG. 2(*c*) is a schematic sectional view in the case where the coil body portion and the ferromagnetic member are received in a protection metal pipe;

FIG. 10(*b*) is an explanatory view showing a state of the spark plug viewed from the combustion chamber side when the spark plug is mounted in the cylinder head as shown in FIG. 10(*a*).

Figure 1A:
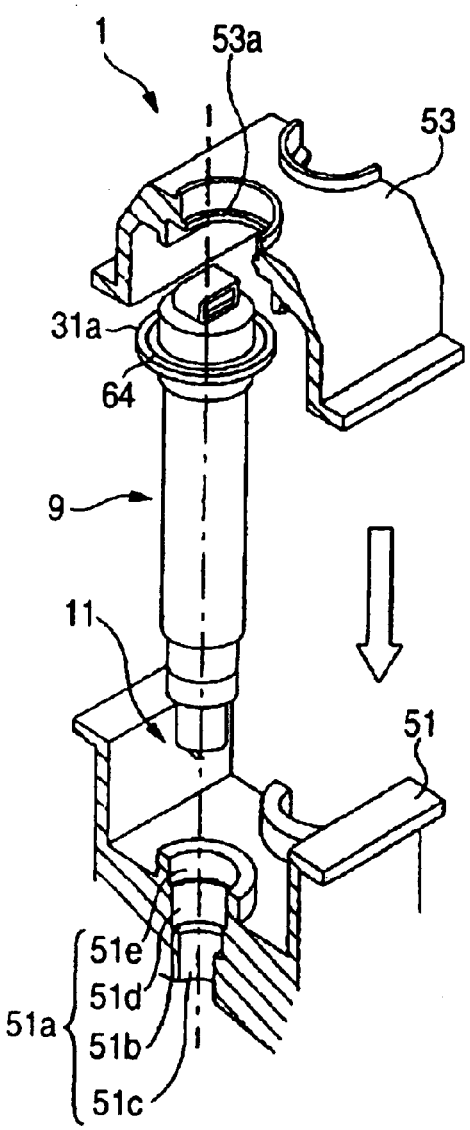
FIG. 1(*a*) is an explanatory view showing a state in which an ignition coil is mounted in between a cylinder head and a cylinder head cover while coupled integrally with a spark plug.

Incidentally, in the drawings, the reference numeral (or sign) 1 designates internal combustion engine ignition system; 9, ignition coil; 9*a*, second ignition coil; 11, spark plug; 17, center electrode; 19, metal shell; 23, collar portion; 23*a*, plug bearing surface; 21, ground electrode; 31, protection metal pipe; 37, coil body portion; 41, high voltage output terminal; 43, insulating member; 45, ferromagnetic member; 47, second protection metal pipe; 47*c*, rear side metal pipe; 47*d*, front side metal pipe; 51, cylinder head; 53, cylinder head cover; 63, oil seal; 71, gasket; CO, core; L1, primary winding; L2, secondary winding; 72, third protection metal pipe; 75, primary bobbin; 76, abutment portion; 79, insulating material; 81, sealing member; 83, position regulating portion; 84, fourth protection metal pipe; 85, second position regulating portion; 86, fifth protection metal pipe; 87, step surface; 91, secondary bobbin; and 129, ionic current detection circuit.

BEST MODE FOR CARRYING OUT THE INVENTION

Embodiments of the present invention will be described below with reference to the drawings.

Figure 1B:
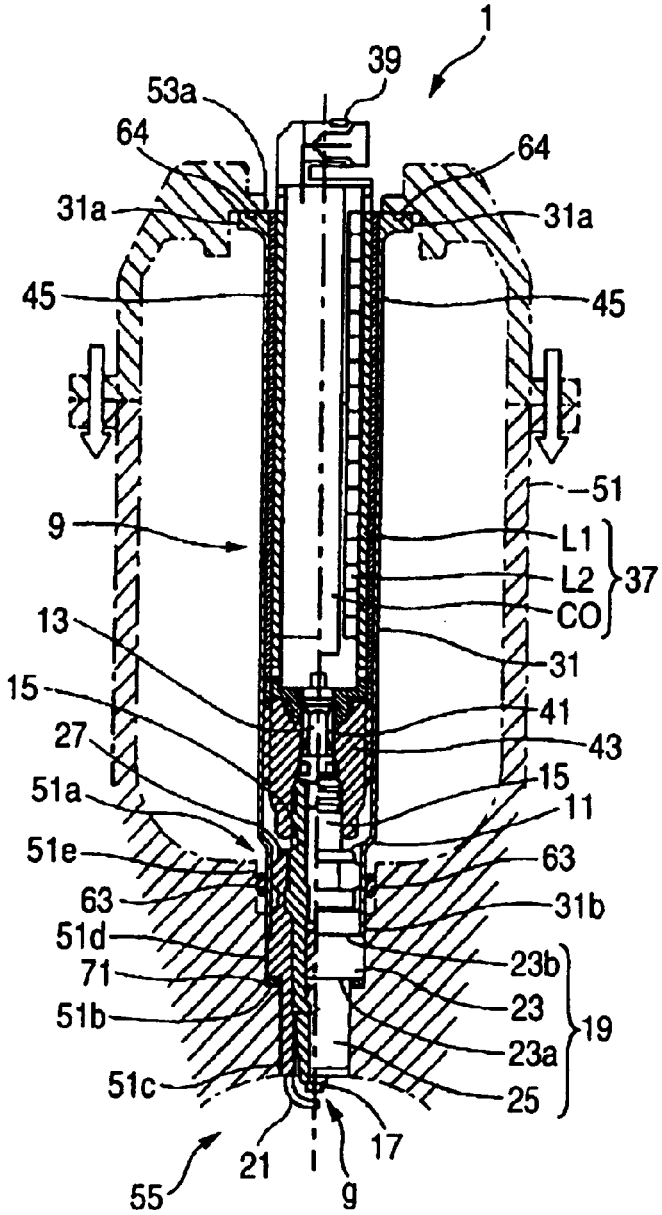
Figure 2A:
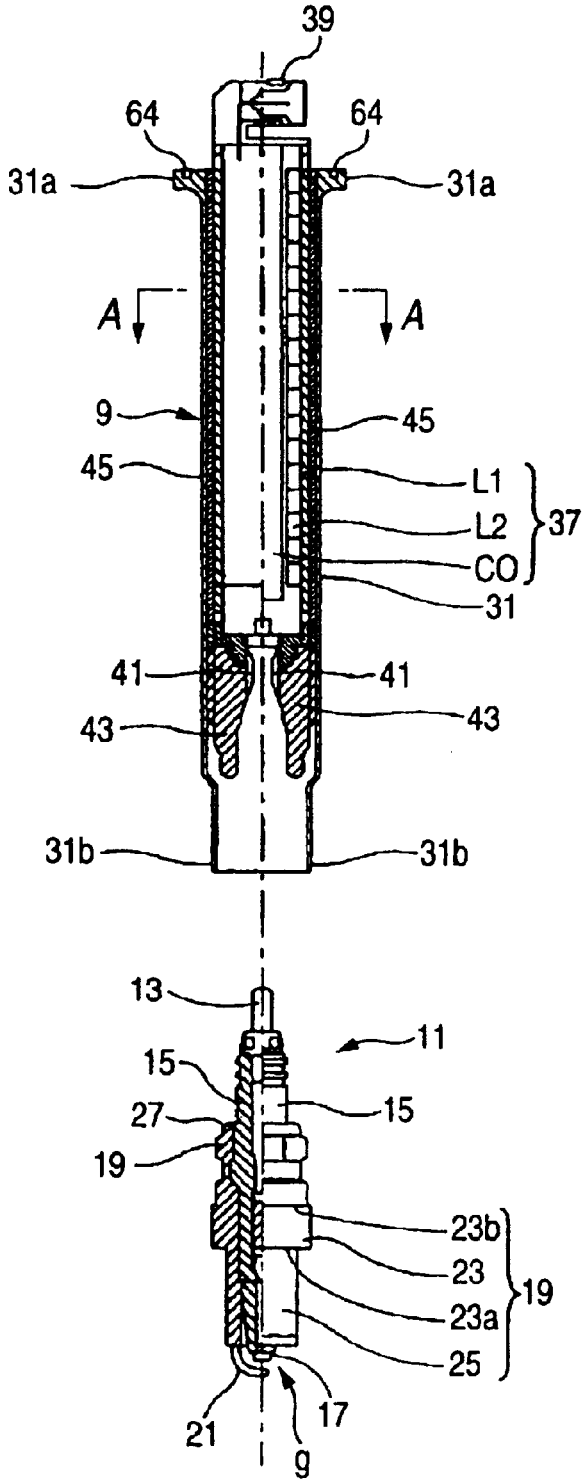
FIG. 2(*a*) is an explanatory view showing the ignition coil and the spark plug in a state in which they are separated from each other.
Figure 2B:
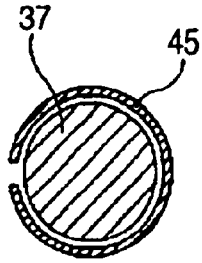
Figure 2C:
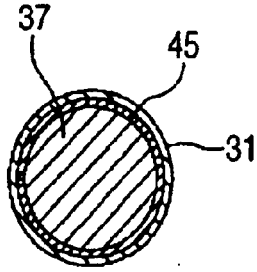

FIG. 1(*a*) is an explanatory view showing a state in which an ignition coil 9 provided in an internal combustion engine ignition system 1 according to a first embodiment is mounted in between a cylinder head 51 and a cylinder head cover 53 while the ignition coil 9 is directly connected to a spark plug 11. FIG. 1(*b*) is a sectional view of the cylinder head 51 and the cylinder head cover 53 after the ignition coil 9 and the spark plug 11 are mounted. FIG. 2(*a*) is a sectional view of the ignition coil 9 and the spark plug 11 in a state in which they are separated from each other.

Although the ignition coil 9 and the spark plug 11 are formed separately as shown in FIG. 2(*a*), the ignition coil 9 is directly connected to the spark plug 11 in a state in which the ignition coil 9 is mounted in the cylinder head 51 of the internal combustion engine as shown in FIG. 1(*b*). The ignition coil 9 and the spark plug 11 are disposed between the cylinder head 51 and the cylinder head cover 53 in a state in which the spark plug 11 is disposed in a plug arrangement hole 51*a* provided in the cylinder head 51.

Incidentally, an intake/exhaust valve drive mechanism (not shown in FIGS. 1(*a*) and 1(*b*)) having a cam shaft or the like for driving an intake valve and an exhaust valve is provided in a space formed between the cylinder head 51 and the cylinder head cover 53. Lubricating oil is circulated for operating the intake/exhaust valve drive mechanism smoothly.

The cylinder head 51 has the plug arrangement hole 51*a* for disposing the spark plug 11 therein. The plug arrangement hole 51*a* has a step surface 51*b* touching the spark plug 11 directly or indirectly through another member (a gasket 71 in this embodiment), a first wall surface 51*c* provided on a side (lower side in FIG. 1(*b*)) nearer to a combustion chamber 55 than the step surface 51*b*, and second and third wall surfaces 51*d* and 51*e* provided on a side (upper side in FIG. 1(*b*)) nearer to the cylinder head cover 53 than the step surface 51*b*.

The internal combustion engine ignition system 1 includes an ignitor or the like (not shown in FIGS. 1(*a*) and 1(*b*)) having a power switching element, besides the ignition coil 9 and the spark plug 11. The ignitor controls the conduction/interruption of a current carried to a primary winding L1 of the ignition coil 9 on the basis of an ignition command signal to thereby generate an ignition voltage in a secondary winding L2. When the ignition voltage is applied to the spark plug 11, a spark discharge is generated in a spark discharge gap formed between a center electrode 17 and a ground electrode 21 of the spark plug 11. That is, the internal combustion engine ignition system 1 is a system for generating a spark discharge in the spark discharge gap g of the spark plug 11 to thereby ignite an air-fuel mixture.

Next, as shown in FIG. 1(*b*) or FIG. 2(*a*), the ignition coil 9 includes a coil body portion 37 which has a coil core CO as a long iron core, a secondary winding L2 disposed around the coil core CO, and a primary winding L1 disposed around the secondary winding L2. Incidentally, the primary winding L1 and the secondary winding L2 are concentrically wound around the coil core CO. Although this embodiment shows a structure in which the primary winding L1 is disposed on the outer side of the secondary winding L2, there may be a structure in which the primary winding L1 is disposed on the inner side of the secondary winding L2. In this embodiment, the coil core CO is formed into a long shape, so that a so-called open magnetic circuit type ignition coil is constituted. The ignition coil 9 includes a ferromagnetic member 45 of a ferromagnetic substance in the outer circumference of the coil body portion 37. The ignition coil 9 is formed so that the coil body portion 37 and the ferromagnetic member 45 are received in a cylindrical metal pipe 31.

The ferromagnetic member 45 is formed in such a manner that a ferromagnetic substance shaped like a rectangular plate is bent cylindrically so that a pair of opposite sides face each other. The ferromagnetic member 45 is disposed so that the outer circumference of the coil body portion 37 is covered with the ferromagnetic member 45. A schematic sectional view of the coil body portion 37 and the ferromagnetic member 45 in a direction perpendicular to the axial direction in the case where the ferromagnetic member 45 is disposed to cover the circumference of the coil body portion 37 in this manner is as shown in FIG. 2(*b*). Incidentally, Fe, Co, Ni, and ferromagnetic or ferrimagnetic substances such as ferrite or the like can be listed as examples of the ferromagnetic substance.

A schematic sectional view of the coil body portion 37, the ferromagnetic member 45 and the protection metal pipe 31 in a direction perpendicular to the axial direction in the case where the coil body portion 37 and the ferromagnetic member 45 are received in the protection metal pipe 31 can be expressed as shown in FIG. 2(*c*). That is, the coil body portion 37, the ferromagnetic member 45 and the protection metal pipe 31 are disposed successively viewed from the center of the ignition coil 9 toward the outside. Incidentally, the coil body portion 37 and the ferromagnetic member 45 are integrated with the protection metal pipe 31 by an insulating resin (e.g., an epoxy resin) with which the inside of the protection metal pipe 31 is filled (vacuum-filled), so that the coil body portion 37 and the ferromagnetic member 45 cannot rotate in the axial direction. On this occasion, the whole circumference of the coil body portion 37 is covered with the ferromagnetic member 45. Incidentally, FIG. 2 (*c*) is a sectional view of the ignition coil 9 taken along the line A—A in FIG. 2(*a*).

As shown in FIG. 1(*b*) and FIG. 2(*a*), the axial length of the ferromagnetic member 45 is substantially equal to the axial length of the coil body portion 37 (specifically, the long coil core CO). Accordingly, when magnetic flux is generated by current conduction to the primary winding L1, the coil core CO itself forms an open magnetic circuit as described above but the coil core CO combined with the ferromagnetic member 45 substantially forms a closed magnetic circuit as a magnetic circuit through which the magnetic flux passes.

Next, a connector portion 39 for electrically connecting the primary winding L1 to external equipment such as a battery or the like is provided in the upper portion (the upper portion in FIG. 1(*b*)) of the coil body portion 37 whereas a high voltage output terminal 41 which is an output terminal of the ignition voltage generated in the secondary winding L2 is provided on the front end side (the lower side in FIG. 1(*b*)) of the coil body portion 37. In the ignition coil 9, the magnetic flux density of the coil core CO varies precipitously according to the conduction/interruption control of the current carried to the primary winding L1 as described above, so that the ignition voltage is generated in the secondary winding L2 and supplied to the spark plug 11 (specifically, a terminal electrode 13 of the spark plug 11) through the high voltage output terminal 41.

The protection metal pipe 31 of the ignition coil 9 is made of a feeble-magnetic substance and shaped like a cylinder having a rear end 31*a* opened, and a front end 31*b* opened. Incidentally, in the protection metal pipe 31, the rear end 31*a* is formed into a shape in which the outer diameter of the rear end 31*a* is enlarged to be larger than that of the cylindrical portion so that the rear end 31*a* can abut on a circumferential inner wall of an opening portion 53*a* of the cylinder head cover 53. In the protection metal pipe 31 of the ignition coil 9, the front end 31*b* is formed into a shape in which the diameter of the front end 31*b* is reduced to be smaller than that of the cylindrical portion so that the front end 31*b* can be pressed into the plug arrangement hole 51*a* of the cylinder head 51 while the rear end side of the spark plug 11 can be received in the inside of the front end 31*b*. When pressed and fixed into the cylinder head 51, the protection metal pipe 31 of the ignition coil 9 serves as a function of protecting the coil body portion 37 and also as a function of a plughole pipe for isolating the spark plug 11 from lubricating oil of the internal combustion engine. Incidentally, substances such as Cr, Mn, FeO, Al, etc., can be listed as examples of the feeble-magnetic substance.

In the condition that the high voltage output terminal 41 electrically connected to the secondary winding L2 is received in the inside of the protection metal pipe 31 of the ignition coil 9 while the protection metal pipe 31 makes the connector portion 39 protruded from the rear end 31*a*, the coil body portion 37 and the ferromagnetic member 45 are integrally received in the inside of the protection metal pipe 31 so as to be not capable of rotating in the axial direction. Further, an insulating member 43 formed to cover the circumference of the high voltage output terminal 41 is disposed on the front end side of the coil body portion 37 in the inside of the protection metal pipe 31. Incidentally, the insulating member 43 is made of an insulating material such as a resin, rubber, or the like, and formed so that the rear end side circumference of the spark plug 11 which will be described later, i.e., the circumference of the terminal electrode 13 and an insulator 15 is also covered with the insulating member 43.

Next, as shown in FIG. 1(*b*) or FIG. 2(*a*), the spark plug 11 includes a center electrode 17 inserted in the front end side of an axial hole of the insulator 15, a metal shell 19 surrounding the radial circumference of the insulator 15, a ground electrode 21 extended from the front end portion of the metal shell 19 so that a spark discharge gap g is formed between the center electrode 17 and the ground electrode 21, and a terminal electrode 13 inserted in the rear end side of the axial hole of the insulator 15 and electrically connected to the center electrode 17.

Of them, the metal shell 19 has a collar portion 23, and a front end portion 25. The collar portion 23 has a plug bearing surface 23*a* on its front end side. The plug bearing surface 23*a* touches the cylinder head 51 (specifically, the step surface 51*b* of the plug arrangement hole 51*a*) directly or indirectly through another member (a gasket 71 in this embodiment). The front end portion 25 has a smooth surface as a cylindrical outer circumferential surface which has no thread groove and which is extended from the plug bearing surface 23*a* of the collar portion 23 to the axial front end side. Further, a rear end surface 23*b* is formed on a side opposite to the plug bearing surface 23*a* of the collar portion 23. Further, the circumferential edge of the rear end portion of the metal shell 19 itself is caulked toward the outer circumferential portion of the insulator 15 to thereby form a caulked portion 27. The caulked portion 27 can prevent the insulator 15 engaged with a metal shell side engagement portion (not shown) formed in the inside of the metal shell 19 from dropping out, so that the insulator 15 is held with respect to the metal shell 19.

The protection metal pipe 31 of the ignition coil 9 is formed so that the rear end side portion-of the metal shell 19 of the spark plug 11 in the rear of the rear end surface 23*b* of the collar portion 23 can be received in the inside of the protection metal pipe 31 from the front end 31*b*. The protection metal pipe 31 is formed so that the inner diameter of the front end 31*b* is smaller than the outer diameter of the collar portion 23 of the metal shell 19, and that the end portion of the front end 31*b* abuts on the rear end surface 23*b* of the collar portion 23 of the metal shell 19.

When the spark plug 11 is inserted in the inside of the protection metal pipe 31 of the ignition coil 9 from the front end 31*b* side, the high voltage output terminal 41 and the terminal electrode 13 are fitted to each other and the rear end side circumference of the insulator 15 in the spark plug 11 is covered with the insulating member 43. As a result, the ignition coil 9 and the spark plug 11 are directly connected to each other (see FIG. 1(*b*)). On this occasion, while the front end 31*b* of the protection metal pipe 31 abuts on the rear end surface 23*b* of the collar portion 23 of the metal shell 19, the outer circumference of the protection metal pipe 31 is pressed into the plug arrangement hole 51*a*. As a result, the protection metal pipe 31 (i.e., the ignition coil 9) is fixed into the cylinder head 51.

Incidentally, the high voltage output terminal 41 has a plurality of contact portions each substantially shaped like a column and elastically deformed in the radial direction of the ignition coil 9. The contact portions are disposed radially around the center axis of the ignition coil 9 and have elastic force toward the center axis. The terminal electrode 13 is substantially shaped like a column. Accordingly, when the high voltage output terminal 41 and the terminal electrode 13 are fitted and connected to each other, the terminal electrode 13 is disposed in the center portion of the plurality of contact portions disposed radially in the inside of the high voltage output terminal 41 while the plurality of contact portions abut on the terminal electrode 13 by their own elastic force.

Because the plurality of contact portions touch the terminal electrode 13 in this manner, the contact area between the high voltage output terminal 41 and the terminal electrode 13 can be enlarged to suppress contact resistance to a low value. Furthermore, because the plurality of contact portions are elastically deformed, any one of the contact portions can be kept in contact with the terminal electrode 13 by the elastic deformation even in the case where vibration occurs in the internal combustion engine. As a result, contact failure between the high voltage output terminal 41 and the terminal electrode 13 hardly occurs, so that variation in contact resistance can be suppressed. Furthermore, in such a connection structure, the high voltage output terminal 41 and the terminal electrode 13 can be attached to and detached from each other. Accordingly, after directly connected to each other, the ignition coil 9 and the spark plug 11 can be separated from each other.

When the protection metal pipe 31 of the ignition coil 9 is pressed into the plug arrangement hole 51*a* of the cylinder head 51 from the front end 31*b* side after the ignition coil 9 and the spark plug 11 are directly connected to each other, the front end 31*b* side outer surface of the protection metal pipe 31 is pressed into the second wall surface 51*d* of the plug arrangement hole 51*a* so that the ignition coil 9 and the spark plug 11 directly connected to each other are fixed into the cylinder head 51.

Incidentally, when the protection metal pipe 31 of the ignition coil 9 is pressed into the plug arrangement hole 51*a*, the gasket 71 is disposed between the plug bearing surface 23*a* of the collar portion 23 of the spark plug 11 and the step surface 51*b* while the oil seal 63 is disposed between the protection metal pipe 31 and the third wall surface 51*e* of the plug arrangement hole 51*a*. Further, the first wall surface 51*c* of the plug arrangement hole 51*a* faces the front end portion 25 of the spark plug 11.

The oil seal 63 is an annularly formed member made of an elastically deformable material having heat resistance. The sectional shape of the oil seal 63 clamped between the protection metal pipe 31 and the third wall surface 51*e* is deformed to block a gap formed between the protection metal pipe 31 and the cylinder head 51 (specifically, the third wall surface 51*e*). Accordingly, the oil seal 63 can prevent lubricating oil from penetrating in between the protection metal pipe 31 and the cylinder head 51. The oil seal 63 is disposed so as to be fitted into a bottomed cylindrical recess (not shown) formed in a circumferential direction in the outer circumferential surface of the protection metal pipe 31. When the protection metal pipe 31 is pressed into the plug arrangement hole 51*a*, the oil seal 63 is clamped between the protection metal pipe 31 and the third wall surface 51*e* of the plug arrangement hole 51*a* while elastically deformed therebetween. Incidentally, the oil seal 63 is not shown in FIG. 1(*a*).

Then, the cylinder head cover 53 is fixed to an upper portion of the cylinder head 51 to thereby make the rear end 31*a* of the protection metal pipe 31 abut on the circumferential inner wall of the opening portion 53*a* of the cylinder head cover 53. As a result, the ignition coil 9 and the spark plug 11 directly connected to each other are clamped between the cylinder head 51 and the cylinder head cover 53 as shown in FIG. 1(*b*) in a state in which the spark plug 11 is disposed in the plug arrangement hole 51*a* of the cylinder head 51 while the protection metal pipe 31 of the ignition coil 9 has the front end 31*b* side pressed into the plug arrangement hole 51*a* and the rear end 31*a* abutting on the inner surface of the cylinder head cover 53. In this manner, the protection metal pipe 31 is fixed to the cylinder head 51 so that the plug bearing surface 23*a* of the collar portion 23 of the metal shell 19 is pressed against the cylinder head 51 while the front end 31*b* of the protection metal pipe 31 of the ignition coil 9 abuts on the rear end surface 23*b* of the collar portion 23 of the metal shell 19. Even in the case where combustion pressure is generated by combustion of an air-fuel mixture, the spark plug 11 having no thread groove in the outer circumferential surface of the front end portion 25 of the metal shell 19 can be fixed to the cylinder head 51 stably.

Incidentally, on this occasion, a second oil seal 64 (see FIG. 1(*a*) and FIG. 1(*b*)) for preventing penetration of lubricating oil is disposed between the increased diameter portion of the rear end 31*a* of the protection metal pipe 31 and the circumferential inner wall of the opening portion 53*a* of the cylinder head cover 53. The second oil seal 64 prevents lubricating oil from leaking from between the rear end 31*a* of the protection metal pipe 31 and the cylinder head cover 53 and prevents lubricating oil from entering through the rear end 31*a* and being deposited on the spark plug 11. In addition, the second oil seal 64 prevents lubricating oil from leaking to the outside of the engine.

In this manner, in the spark plug 11 mounted in the plug arrangement hole 51*a*, while the front end 31*b* of the protection metal pipe 31 pressed into the plug arrangement hole 51*a* abuts on the rear end surface 23*b* of the collar portion 23 of the metal shell 19, the protection metal pipe 31 presses the plug beating surface 23 *a* against the cylinder head 51. Accordingly, the spark plug 11 having no thread groove can be fixed to the cylinder head 51 stably even in the case where combustion pressure is generated by combustion of an air-fuel mixture.

Figure 10A:
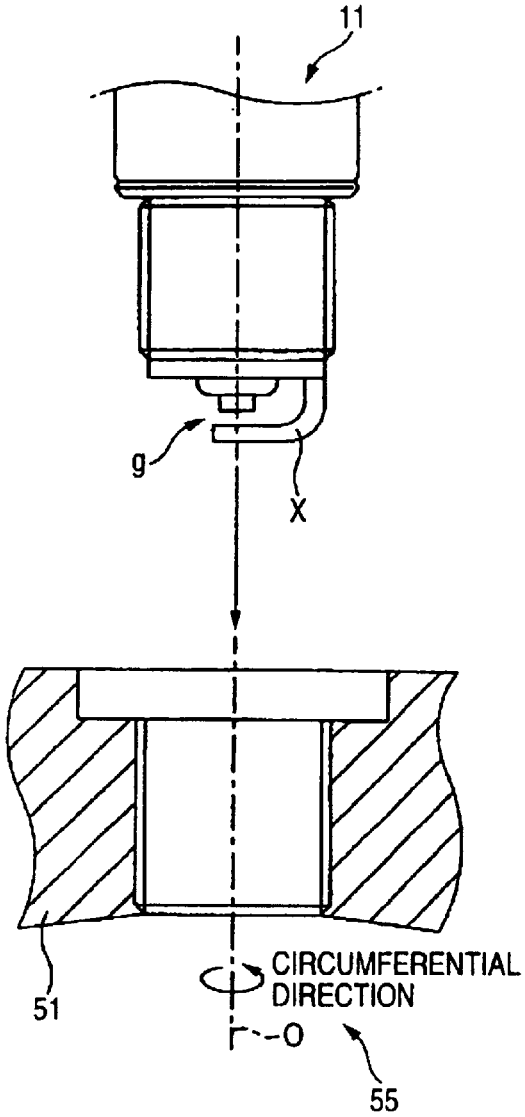
FIG. 10(*a*) is an explanatory view showing a state in which the spark plug is to be mounted in the cylinder head.
Figure 10B:
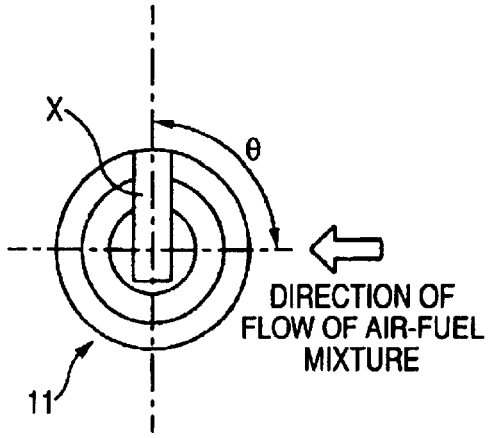

In the spark plug 11, as described above, there is no thread groove provided in the outer circumferential surface of the front end portion 25 of the metal shell 19, so that a method using thread engagement is not used as the method of fixing the spark plug 11 to the cylinder head 51. Accordingly, setting can be made easily so that the position of the portion of coupling of the ground electrode 21 to the metal shell 19 becomes a specific position (in which the angle between the ground electrode X and a flow of an air-fuel mixture is $\theta=90°$ or $270°$ as shown in FIG. 10) in a circumferential direction around the axial line of the plug arrangement hole 51*a* (in other words, the position of the ground electrode 21 arranged in the combustion chamber 55 satisfies a specific position). The spark plug 11 can be inserted in the plug arrangement hole 51*a* of the cylinder head 51 without thread engagement, so that the spark plug can be mounted easily.

For this reason, when the ignition coil 9 and the spark plug 11 directly connected to each other are mounted in the plug arrangement hole 51*a* straightly without rotation while the position, relative to the cylinder head 51, of the ground electrode 21 arranged in the combustion chamber 55 is set in advance, the ground electrode 21 of the spark plug 11 can be easily arranged in a specific position in the combustion chamber 55. When the cylinder head cover 53 is then fixed to the upper portion of the cylinder head 51 so that the ignition coil 9 and the spark plug 11 are then clamped between the cylinder head cover 53 and the cylinder head 51, the ignition coil 9 and the spark plug 11 can be fixed to the cylinder head 51 more stably.

Incidentally, in the internal combustion engine ignition system 1 according to this embodiment, the spark plug 11 is fixed to the cylinder head 51 by the protection metal pipe 31 as one of constituent members of the ignition coil 9 while the position of the ground electrode 21 arranged in the combustion chamber 55 is set so that the ignitability of the air-fuel mixture is good (the angle between the ground electrode X and a flow of the air-fuel mixture is $\theta=90°$ or 270° as shown in FIG. 10), in consideration of the direction of turbulence of an air-fuel mixture in the combustion chamber 55.

As described above, in the internal combustion engine ignition system according to the first embodiment, the ignition coil 9 is provided in a state in which the ignition coil 9 is directly connected to the spark plug 11. Furthermore, because the protection metal pipe 31 of the ignition coil 9 is formed to serve also as a function of a plughole pipe, it is unnecessary to dispose any other plughole pipe than the protection metal pipe 31. For this reason, the external diameter of the protection metal pipe 31 can be enlarged up to the external diameter of a conventional plughole pipe. As a result, the installation space for the coil body portion 37 can be secured largely in the inside of the protection metal pipe 31, so that the installation space need not be changed largely when the ignition coil is mounted in the cylinder head.

Furthermore, because the protection metal pipe 31 of the ignition coil 9 is formed as a plughole pipe, the operation of fixing the plughole pipe (the protection metal pipe 31 in this embodiment) to the cylinder head 51 and the operation of mounting the ignition coil 9 in the cylinder head 51 can be performed simultaneously. That is, the operation of fixing the ignition coil 9 and the plughole pipe (the protection metal pipe 31 in this embodiment) to the cylinder head 51 can be made by one operation.

Furthermore, the protection metal pipe 31 of the ignition coil 9 is clamped by the second wall surface 51*d* when pressed into the plug arrangement hole 51*a* and is further clamped between the cylinder head 51 and the cylinder head cover 53. Accordingly, the ignition coil 9 and the spark plug 11 directly connected to each other are fixed to the cylinder head 51 firmly. For this reason, even in the case where combustion pressure is generated by combustion of an air-fuel mixture, the ignition coil 9 and the spark plug 11 directly connected to each other are fixed to the cylinder head 51 surely without dropping out of the plug arrangement hole 51*a*.

Figure 3:
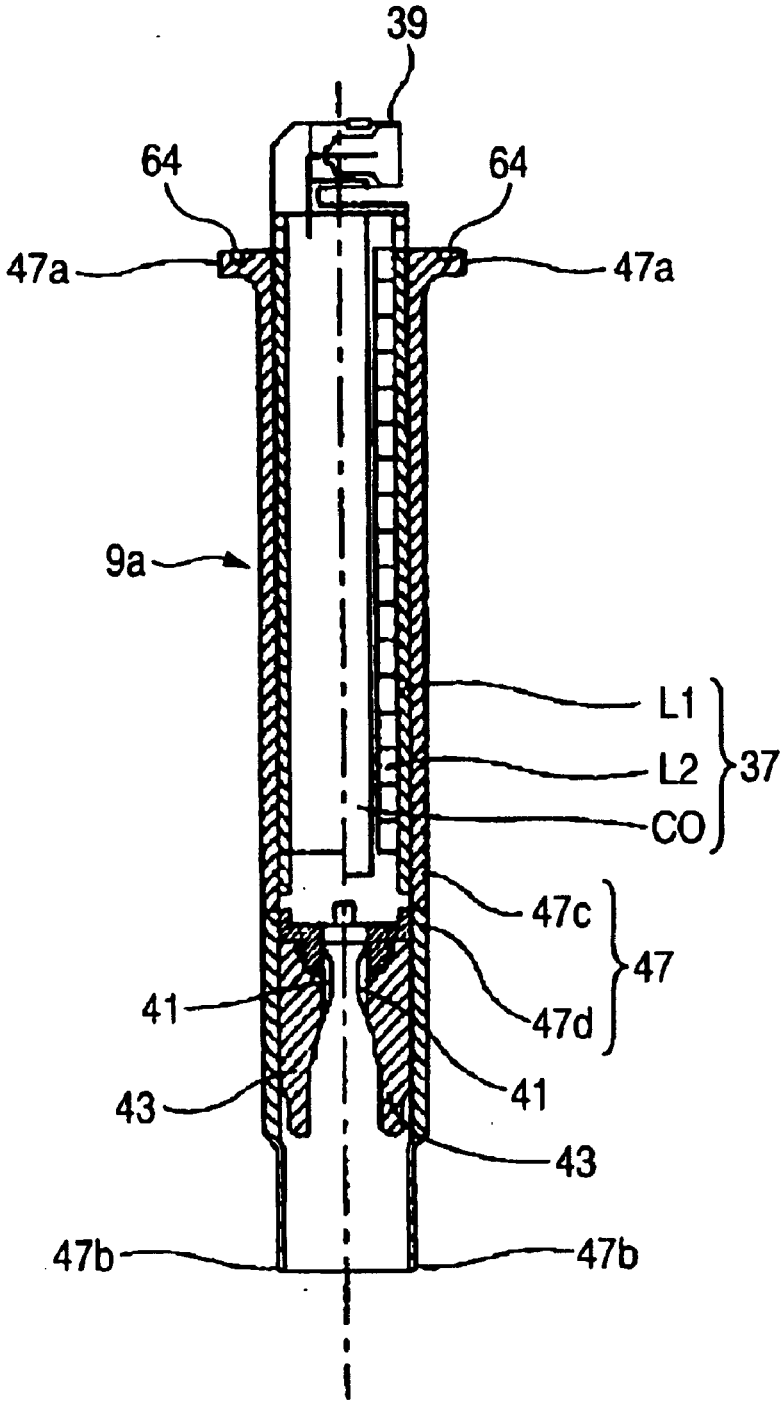
FIG. 3 is a sectional view of a second ignition coil from a side.

A second ignition coil 9*a* formed by using a second protection metal pipe 47 partially made of a ferromagnetic substance will be described below as a second embodiment. FIG. 3 shows an axial sectional view of the second ignition coil 9*a*. Incidentally, the second ignition coil 9*a* in the second embodiment is formed so that the second ignition coil 9*a* can be integrally coupled to the spark plug 11 in the first embodiment, and is formed so that the second ignition coil 9*a* can be disposed between the cylinder head 51 and the cylinder head cover 53. Incidentally, the structures of the spark plug 11, the cylinder head 51 and the cylinder head cover 53 are the same as those in the first embodiment and the description thereof will be omitted here.

The second ignition coil 9*a* includes a coil body portion 37, a second protection metal pipe 47, and an insulating member 43.

First, the coil body portion 37 is formed in the same manner as in the ignition coil 9 described in the first embodiment, that is, the coil body portion 37 has a long coil core CO forming an open magnetic circuit, and a secondary winding L2 and a primary winding L1 wound concentrically around the coil core CO. The insulating member 43 is also formed in the same manner as in the ignition coil 9 described in the first embodiment.

The second protection metal pipe 47 is integrally formed in such a manner that after a cylindrical rear side metal pipe 47*c* made of a ferromagnetic substance and a cylindrical front side metal pipe 47*d* made of a feeble-magnetic substance are laminated on each other vertically in an axial direction so that the center axes of the two metal pipes are aligned on one and the same line, end portions of the two metal pipes abutting on each other are joined to each other. Incidentally, the second protection metal pipe 47 is formed so that the whole shape in the case where the rear side metal pipe 47*c* and the front side metal pipe 47*d* are joined to each other is the same as the shape of the protection metal pipe 31 of the ignition coil 9 in the first embodiment. The second protection metal pipe 47 is formed to protect the coil body portion 37 received in the inside of the ignition coil and to serve also a function of a plughole pipe for isolating the spark plug (not shown) from lubricating oil.

In the second protection metal pipe 47, the rear side metal pipe 47*c* is formed to cover the circumference of the coil body portion 37 and to have an axial length substantially equal to the axial length of the coil body portion 37. When magnetic flux is generated by current conduction to the primary winding L1 the rear side metal pipe 47*c* combined with the coil core CO can form substantially a closed magnetic circuit as a magnetic circuit through which the magnetic flux passes. On the other hand, the front side metal pipe 47*d* made of a feeble-magnetic substance forms no magnetic circuit for the magnetic flux generated in the coil body portion 37.

That is, the second protection metal pipe 47 contains a ferromagnetic substance which is arranged so that a magnetic circuit is not formed on the whole portion of from the rear end 47*a* to the front end 47*b* but formed only on a portion corresponding to the circumference of the coil body portion 37. Because the rear side metal pipe 47*c* made of a ferromagnetic substance is disposed in a part of the coil body portion 37, particularly in a portion corresponding to the circumference of the coil core CO, a closed magnetic circuit can be substantially formed when magnetic flux is generated by current conduction to the primary winding L1. Because the length of the magnetic circuit in this case is shortened compared with the case where a magnetic circuit is formed on the whole portion of from the rear end 47*a* to the front end 47*b* of the second protection metal pipe 47, the magnetic circuit formed does not become wastefully long.

Incidentally, the coil body portion 37 is provided in the same manner as in the ignition coil 9 in the first embodiment, that is, the coil body portion 37 is integrated with the second protection metal pipe 47 by an insulating resin (e.g., an epoxy resin) with which the inside of the second protection metal pipe 47 is filled, so that the coil body portion 37 cannot rotate in the axial direction. The second ignition coil 9*a* is pressed into the plug arrangement hole of the cylinder head so that the second ignition coil 9*a* is fixed to the cylinder head. Though not shown, an oil seal may be provided on the outer circumference of the second protection metal pipe 47 so that the oil seal can be clamped between the second protection metal pipe 47 and the cylinder head in the same manner as in the first embodiment to thereby prevent penetration of lubricating oil.

Accordingly, the internal combustion engine ignition system having the second ignition coil 9*a* described in the second embodiment can be achieved as an internal combustion engine ignition system in which misfire hardly occurs, so that a stable operating state of the internal combustion engine can be kept. In addition, because the number of man-hour for assembling can be made smaller than conventional, reduction in the cost of production of the internal combustion engine can be attained.

Figure 4:
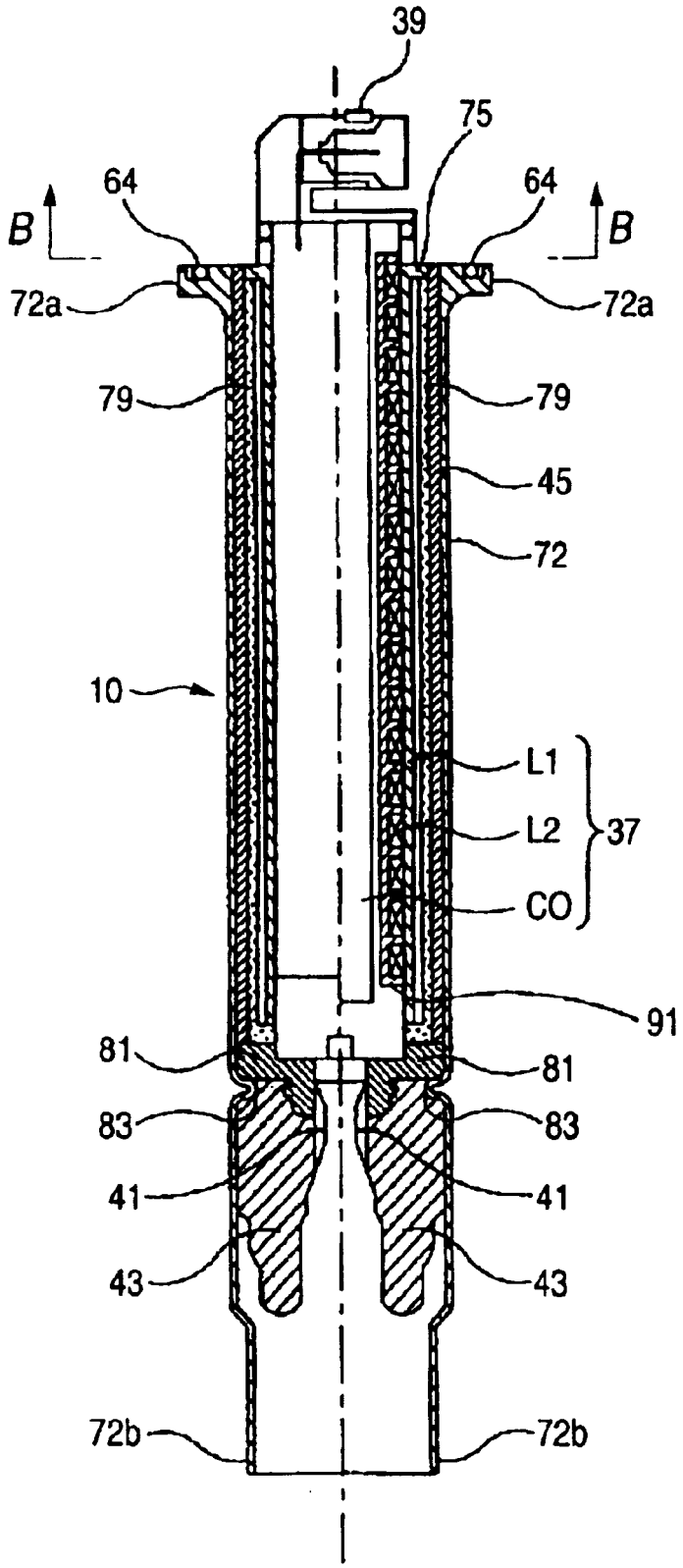
FIG. 4 is a sectional view of a third ignition coil from a side.

A third ignition coil 10 formed by using a third protection metal pipe 72 having a position regulating portion 83 for positioning the axial arrangement of the coil body portion 37 will be described below as a third embodiment. FIG. 4 shows an axial sectional view of the third ignition coil 10.

Incidentally, the third ignition coil 10 in the third embodiment is formed so that the third ignition coil 10 can be integrally coupled to the spark plug 11 in the first embodiment, and is formed so that the third ignition coil 10 can be disposed between the cylinder head 51 and the cylinder head cover 53. Incidentally, the structures of the spark plug 11, the cylinder head 51 and the cylinder head cover 53 are the same as those in the first embodiment and the description thereof will be omitted.

The third ignition coil 10 is formed to include a coil body portion 37, a third protection metal pipe 72, and an insulating member 43.

First, the coil body portion 37 is formed in the same manner as in the ignition coil 9 described in the first embodiment, that is, the coil body portion 37 has a long coil core CO forming an open magnetic circuit, and a secondary winding L2 and a primary winding L1 wound concentrically around the coil core CO. The insulating member 43 is also formed in the same manner as in the ignition coil 9 described in the first embodiment.

Incidentally, the more detailed configuration of the coil body portion 37 is shown in FIG. 4. As is obvious from FIG. 4, the primary winding L1 is wound on the outer circumference of a primary bobbin 75 which is substantially shaped like a cylinder and which is made of an insulating material whereas the secondary winding L2 is wound on the outer circumference of a secondary bobbin 91 which is substantially shaped like a cylinder and which is made of an insulating material.

Figure 5:
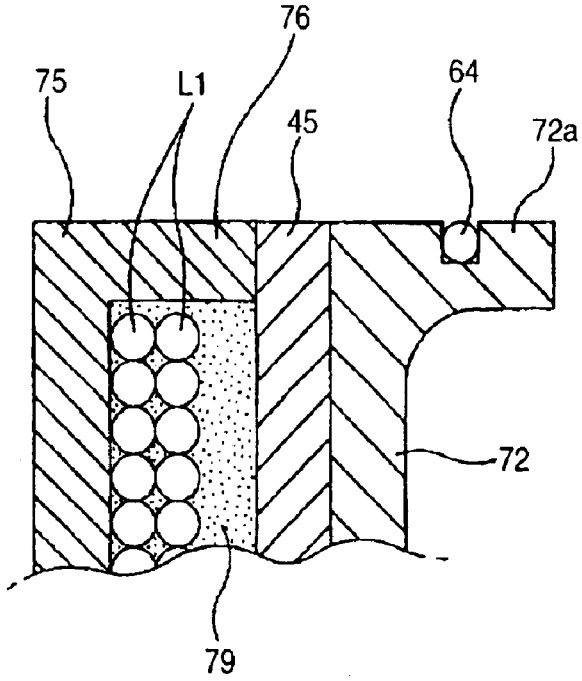
FIG. 5 is an enlarged view in a neighbor of a rear end of a third protection metal pipe in the third ignition coil.

FIG. 5 shows an enlarged view in a neighbor of a rear end 72*a* of the third protection metal pipe 72 in the third ignition coil 10. As shown in FIG. 5, the primary bobbin 75 wound with the primary winding L1 has a flange-shaped abutment portion 76 at its rear end so that the radial size of the abutment portion 76 is enlarged to be larger than the outer diameter of the primary winding L1. The radial size of the abutment portion 76 is set so that a radial end portion of the abutment portion 76 abuts on the ferromagnetic member 45. Because the abutment portion 76 is provided, the position of the coil body portion 37 in a direction perpendicular to the axial line in the inside of the third protection metal pipe 72 formed as a plughole pipe is set so that the coil body portion 37 can be easily disposed in the axial center position in the inside of the third protection metal pipe 72.

An insulating material 79 made of an insulating resin (e.g., an epoxy resin) is filled in between the coil body portion 37 and the third protection metal pipe 72 (the ferromagnetic member 45 in this embodiment). The insulating material 79 is filled therein without any gap with respect to the inner circumferential surface of the third protection metal pipe 72 (specifically, the inner circumferential surface of the ferromagnetic member 45). Because the insulating material 79 is filled therein without any gap in this manner, heat released in the primary winding L1 and the secondary winding L2, etc., by current conduction is conducted through the insulating material 79 and rapidly radiated through the insulating material 79, the ferromagnetic member 45 and the third protection metal pipe 72 toward the cylinder head and the cylinder head cover or toward lubricating oil deposited on the outer surface of the third protection metal pipe 72 for operating the intake/exhaust valve mechanism.

Although filling pressure from the insulating material 79 is applied on the coil body portion 37 at the time of vacuum-filling of the insulating material 79, the position of arrangement of the coil body portion 37 can be kept in the axial center position of the third protection metal pipe 72 because the coil body portion 37 is held stably by the abutment portion 76.

Figure 8:
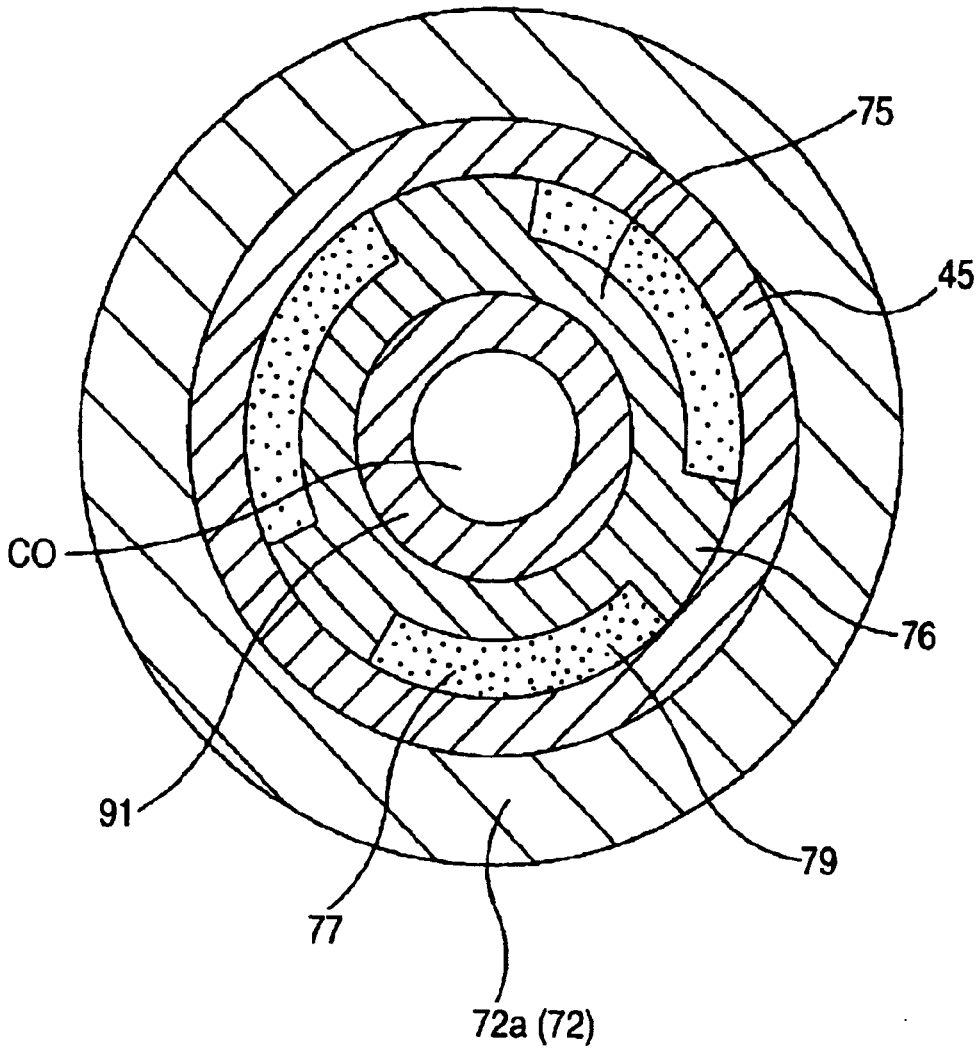
FIG. 8 is a sectional view of the third ignition coil taken along the line B—B in FIG. 4.

FIG. 8 shows a sectional view of the third ignition coil 10 taken along the line B—B in FIG. 4. As is obvious from FIG. 8, three flange-shaped abutment portions 76 in the primary bobbin 75 wound on the outer diameter of the primary winding L1 are formed circumferentially at regular intervals. The radial end portions of the three abutment portions 76 are formed so as to abut on the ferromagnetic member 45. The operation of filling the inside of the third protection metal pipe 72 with the insulating material 79 is performed through opening portions 77 each located between adjacent ones of the abutment portions 76 in the primary bobbin. Accordingly, the inside of the third protection metal pipe 72 can be filled with the insulating material 79 so that a gap is prevented from being generated on the inner circumferential surface of the third protection metal pipe 72 (specifically, the ferromagnetic member 45).

Next, as shown in FIG. 4, the third protection metal pipe 72 has a position regulating portion 83 which is formed in the nearly intermediate position between the axial center position and the front end 72*b* so as to be protruded from the outside toward the inside by caulking. The position regulating portion 83 is formed so as to abut on the coil body portion 37 through a sealing member 81 made of a resin. The sealing member 81 is provided for preventing the insulating material 79 from leaking to the front end 72*b* side at the time of the operation of filling the insulating material 79.

The position regulating portion 83 is provided for positioning the coil body portion 37 in the axial direction of from the rear end 72*a* to the front end 72*b* in the inside of the third protection metal pipe 72. The position regulating portion 83 also has a function of arranging the coil body portion 37 and the spark plug 11 in an appropriate position in the inside of the third protection metal pipe 72.

As described above, in the third ignition coil 10, the insulating material 79 forms a heat-conduction path extended from the coil body portion 37 (specifically, the primary winding L1) to the third protection metal pipe 72. Accordingly, heat released in the coil body portion 37 can be efficiently radiated to the outside through the insulating material 79, the ferromagnetic member 45 and the third protection metal pipe 72. Because heat-radiating characteristic is improved in this manner, a leakage current can be prevented from being caused by the temperature rise of the coil body portion 37. As a result, reduction in performance of the ignition coil can be suppressed because the output voltage value (secondary voltage value) of the coil body portion 37 can be prevented from being reduced.

Incidentally, the thermal conductivity of the insulating material 79 can be adjusted by alteration in the kind and content of the filler. The insulating material may be selected suitably to obtain thermal conductivity in accordance with the purpose of use of the ignition coil. In addition, because the third ignition coil 10 has the position regulating portion 83 in the third protection metal pipe 72, the position of arrangement of the coil body portion 37 in the axial direction in the inside of the third protection metal pipe 72 can be easily determined to be a predetermined position when the coil body portion 37 is arranged in the inside of the third protection metal pipe 72.

Although embodiments of the present invention have been described above, the present invention is not limited to the embodiments and various changes may be made. For example, an ignition coil having a protection metal pipe partially made of a ferromagnetic substance may be formed so that the outside dimension of the protection metal pipe is reduced to be smaller than the outside dimension of the second protection metal pipe 47 of the second ignition coil 9*a*.

That is, the thickness of the cylindrical portion of the second protection metal pipe 47 is a dimension equal to the sum of the thickness of the protection metal pipe 31 and the thickness of the ferromagnetic member 45 in the ignition coil 9 in the first embodiment. The cylindrical portion can be formed thinly to reduce the outside dimension of the protection metal pipe as long as the strength as the protection metal pipe can be kept. When the protection metal pipe is formed in this manner, the outside dimension of the protection metal pipe can be reduced so that the outside dimension of the ignition coil can be reduced compared with the case where the ferromagnetic member and the protection metal pipe are provided separately.

When the ferromagnetic member and the protection metal pipe are provided separately, the ferromagnetic member may be disposed in the inside of the protection metal pipe while the protection metal pipe is made of a feeble-magnetic substance. Incidentally, in this case, the ferromagnetic member may be disposed in a portion corresponding to the circumference of the core in the coil body portion so that the magnetic circuit can be set appropriately to prevent magnetic flux leakage or the like. Further, the cylindrical protection metal pipe may be formed in such a manner that a ferromagnetic substance is used as a member forming the inner side (a side in which the coil body portion is received) of the protection metal pipe while a feeble-magnetic substance is used as a member forming the outer side of the protection metal pipe. In the ignition coil having these protection metal pipes, leakage of magnetic flux can be minimized so that the ignition voltage can be generated efficiently.

The structure of the protection metal pipe of the ignition coil fixed to the cylinder head is not limited to a structure in which the protection metal pipe is pressed into the plug arrangement hole of the cylinder head as described above in the embodiments. Various structures can be achieved. For example, the protection metal pipe of the ignition coil may be fixed to the cylinder head by thread engagement in the condition that a thread groove is provided in the outer circumference of the protection metal pipe while a thread groove corresponding to the thread groove is provided in the cylinder head. The protection metal pipe of the ignition coil may be fixed to the cylinder head by use of a flange portion in such a manner that the flange portion provided to be protruded outward from the outer circumferential surface of the protection metal pipe is screwed to the cylinder head by a bolt or the like. In addition, the ignition coil may be fixed to the cylinder head in such a manner that the ignition coil is clamped between the cylinder head and the cylinder head cover.

Figure 6:
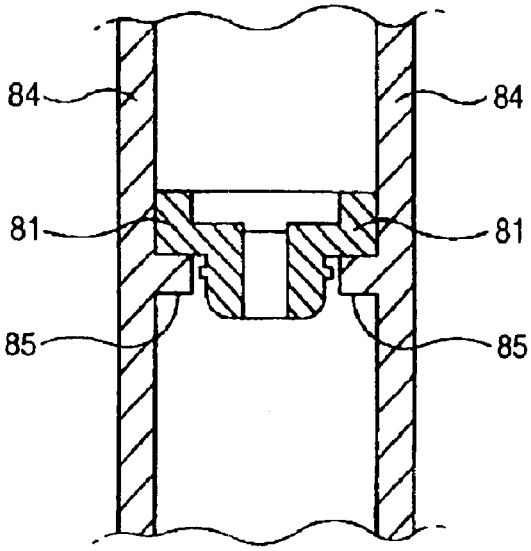
FIG. 6 is a sectional view of a portion of a fourth protection metal pipe in which a second position regulating portion is formed.

Although the third embodiment has shown the case where the protrusion-shaped position regulating portion 83 protruded inward by caulking is used as a position regulating portion for positioning the coil body portion in the axial direction in the inside of the protection metal pipe, the position regulating portion need not be limited to the position regulating portion formed by caulking. For example, as represented by a fourth protection metal pipe 84 shown in FIG. 6, the inner surface of the protection metal pipe may be cut so that a portion protruded inward is left in a predetermined position. In this case, the protruded portion may be formed as a second position regulating portion 85. Like the third protection metal pipe 72, the fourth protection metal pipe 84 is formed so as to abut on the coil body portion through the sealing member 81. Incidentally, the coil body portion 37, the high voltage output terminal 41, etc. are not shown in FIG. 6.

Figure 7:
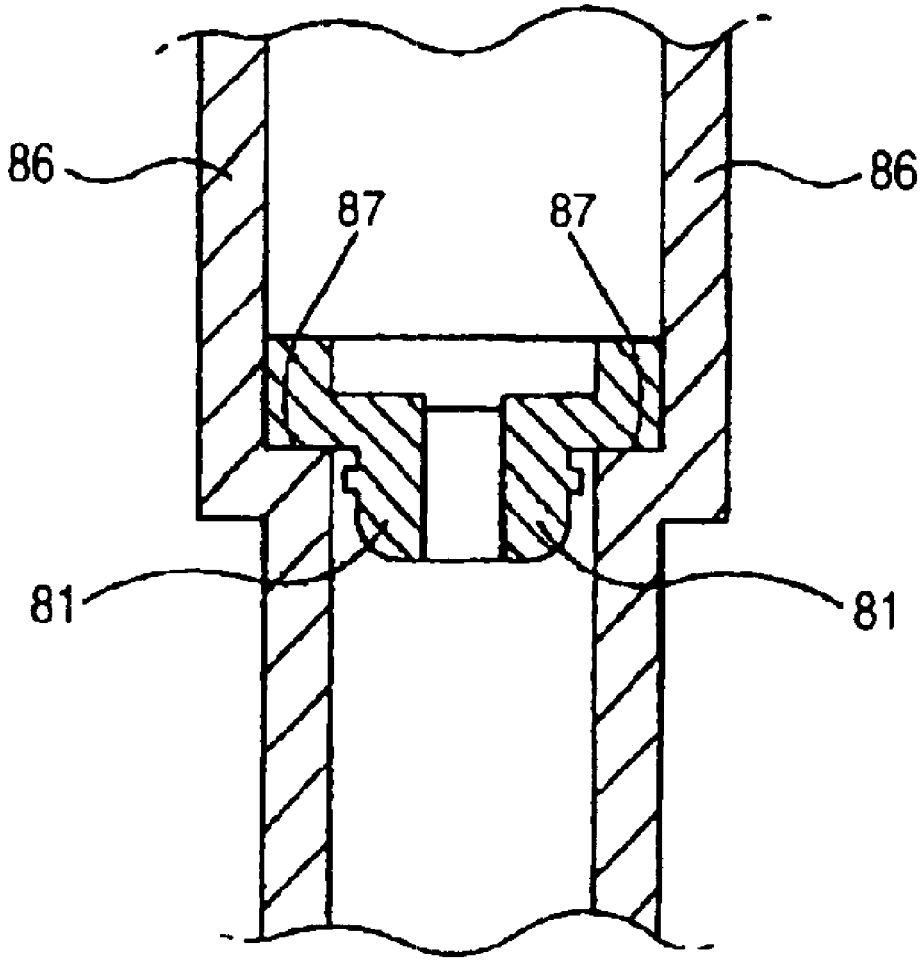
FIG. 7 is a sectional view of a portion of a fifth protection metal pipe in which a step surface is formed.

Further, as represented by a fifth protection metal pipe 86 shown in FIG. 7, a step surface 87 formed in such a manner that a difference in radial size is provided may be provided as a position regulating portion. The step shape is not particularly limited and may be a taper shape. Incidentally, the coil body portion 37, etc. are not shown in FIG. 7, either.

Incidentally, the position regulating portion (the position regulating portion 83, the second position regulating portion 85 or the step surface 87) need not be formed on the whole circumference of the inner surface of the protection metal pipe. That is, the position regulating portion may be formed so that the center axial line of the coil body portion is selected to be parallel to the center axial line of the protection metal pipe to prevent the coil body portion from being inclined. For example, the position regulating portion may be separated into three parts formed at nearly regular intervals in the circumferential direction in the inner surface of the protection metal pipe. Incidentally, when the position regulating portion is formed to be separated into parts, it is preferable that three or more parts are formed, and that the separated parts are disposed at nearly regular intervals in the circumferential direction of the inner surface in order to support the coil body portion stably.

The insulating material 79 is not limited to a resin but may be made of insulating oil. When the coil body portion 37 is positioned by the position regulating portion, the coil body portion 37 may be positioned in such a manner that the primary bobbin and the secondary bobbin abut on the coil body portion 37 without interposition of the sealing member 81.

Figure 9:
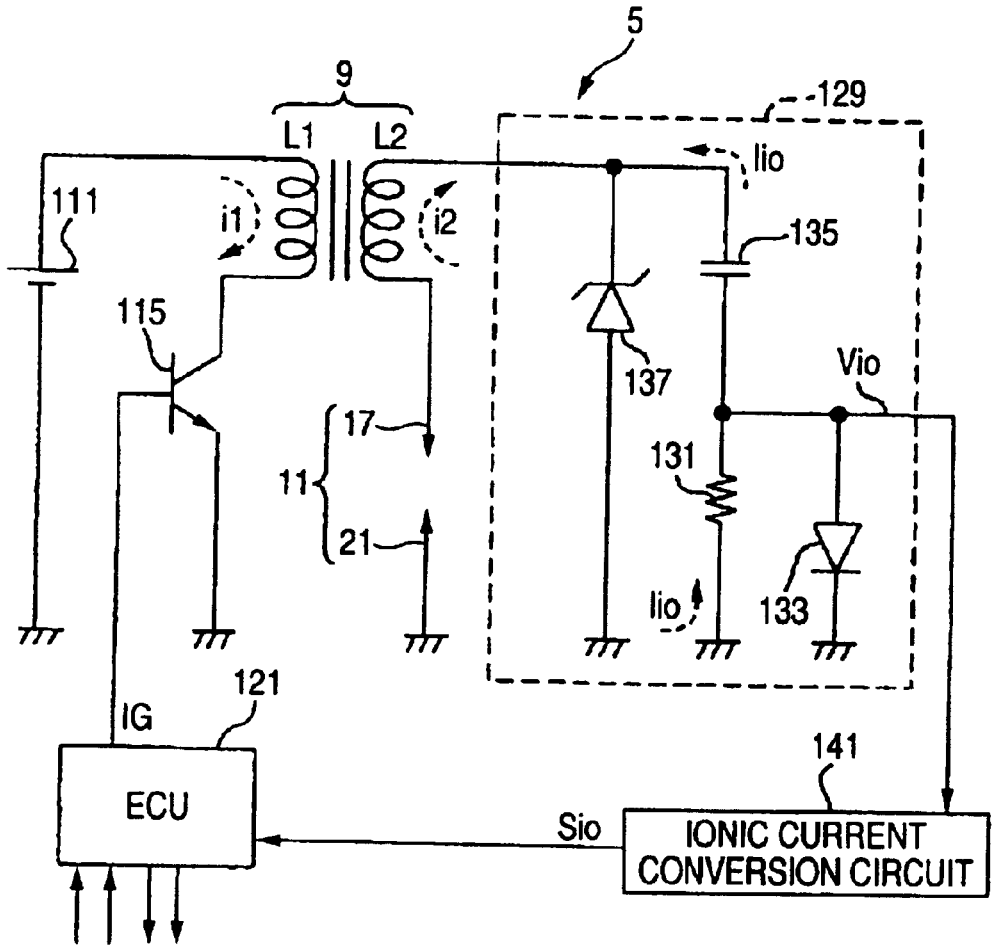
FIG. 9 is an electric circuit diagram of an internal combustion engine ignition system having an ionic current detection circuit.

The internal combustion engine ignition system 1 according to this embodiment may further include an ionic current detection circuit. FIG. 9 shows an example of an electric circuit diagram of the internal combustion engine ignition system having such an ionic current detection circuit (ionic current detection portion). As shown in FIG. 9, the internal combustion engine ignition system 5 includes a DC power supply unit (battery) 111 for supplying a power-supply voltage (e.g., a voltage of 12 V) to the primary winding L1, the ignition coil 9 having the primary winding L1 and the secondary winding L2, a main control transistor 115 made of an npn transistor as an ignitor series-connected to the primary winding L1, an ionic current detection circuit 129 provided on a closed loop composed of the secondary winding L2 and the spark plug 11 for outputting a first detection voltage Vio proportional to the magnitude of an ionic current, an ionic current conversion circuit 141 for outputting an ionic current signal Sio on the basis of the first detection voltage Vio output from the ionic current detection circuit 129, and an electronic control unit (hereinafter referred to as ECU) 121 for outputting an ignition command signal IG to the main control transistor 115 on the basis of the operating state of the internal combustion engine in order to generate a spark discharge in the spark plug 11 and for inputting the ionic current signal Sio from the ionic current conversion circuit 141.

The ECU 121 drive-controls the main control transistor 115 to perform conduction/interruption of a current carried to the primary winding L1 to generate an ignition voltage between opposite ends of the secondary winding L2 to thereby generate a spark discharge between the electrodes 17 and 21 of the spark plug 11.

Next, the ionic current detection circuit 129 includes: an ionic current detection resistor 131 having an end grounded; a capacitor 135 series-connected to an end portion of the ionic current detection resistor 131 opposite to the grounded side; a diode 133 having a cathode grounded, and an anode connected to a connection point between the ionic current detection resistor 131 and the capacitor 135 so that the diode 133 is connected in parallel to the ionic current detection resistor 131; and a Zener diode 137 having a cathode connected to an end portion of the capacitor 135 opposite to the connection side with the ionic current detection resistor 131, and an anode grounded. In the ionic current detection circuit 129 formed in this manner, a connection point between the capacitor 135 and the Zener diode 137 is connected to the secondary winding L2 whereas the connection point between the ionic current detection resistor 131 and the capacitor 135 is connected to the ionic current conversion circuit 141.

Just after a spark discharge is generated, a secondary current i2 flowing from the secondary winding L2 into the ionic current detection circuit 129 goes through a path formed by the capacitor 135 and the diode 133. When the capacitor 135 is charged by conduction of the secondary current i2 so that the voltage between opposite ends of the capacitor 135 becomes equal to the Zener voltage of the Zener diode 137, the Zener diode 137 is Zener-broken down so that the secondary current i2 flowing can go through the Zener diode 137. On this occasion, the capacitor 135 is kept in a charged state.

When the spark discharge is then terminated by reduction in the ignition voltage of the secondary winding L2 so that the secondary current i2 due to the ignition voltage does not flow, the charged capacitor 135 is discharged so that an ionic current Iio flows in a closed loop composed of the capacitor 135, the secondary winding L2, the spark plug 11, the ground and the ionic current detection resistor 131. On this occasion, because the voltage between opposite ends of the ionic current detection resistor 131 is proportional to the magnitude of the ionic current Iio, the first detection voltage Vio exhibits a value proportional to that of the ionic current Iio. The ionic current conversion circuit 141 outputs the ionic current signal Sio to the ECU 121 on the basis of the first detection voltage Vio. Incidentally, the ECU 121 analyzes the ionic current signal Sio to perform judgments, for example, as to misfire, knocking, etc.

The ECU 121 totally controls the ignition timing, the fuel supply quantity, etc. of the internal combustion engine on the basis of results of the judgments. Variation in the resistance value in the current-conduction path connecting the secondary winding L2 and the spark plug 11 has large influence on the detection accuracy in the case where the ionic current is detected thus. When the spark plug and the ignition coil are directly connected to each other as described in the present invention, variation in the resistance value of the current-conduction path can be suppressed so that detection accuracy of the ionic current can be improved. Incidentally, the ionic current detection circuit 129 is equivalent to ionic current detection means described in the Scope of Claim.

Although the present invention has been described in detail with reference to specific embodiments, it is obvious to those skilled in the art that various changes and modifications may be made without departing from the spirit and scope of the present invention.

This application is based on Japanese Patent Application (Japanese Patent Application No. 2001-217866) filed on Jul. 18, 2001, the content of which is incorporated herein by reference.

Industrial Applicability

There is provided an ignition coil having a structure allowed to be directly connected to a spark plug so that the installation space need not be changed largely when the ignition coil is mounted in a cylinder head. There is also provided an internal combustion engine ignition system having the ignition coil.

What is claimed is:

1. An ignition coil comprising: a coil body portion including a primary winding, a secondary winding wound concentric with said primary winding, and a coil core; and a cylindrical protection metal pipe for protecting said coil body portion by receiving said coil body portion in its own inside, wherein said protection metal pipe is formed as a plughole pipe fixed to a cylinder head.

2. The ignition coil according to claim 1, wherein said coil body portion and said protection metal pipe are integrated with each other so that they cannot rotate around an axis.

3. The ignition coil according to claim 1, wherein the inside of said protection metal pipe is filled with an insulating material.

4. The ignition coil according to claim 1, wherein said protection metal pipe has a position regulating portion for positioning said coil body portion in an axial direction in its own inside.

5. An internal combustion engine ignition system comprising:

an ignition coil for generating an ignition voltage and a spark plug supplied with said ignition voltage by said ignition coil for generating a spark discharge are directly connected to each other to make said spark plug generate a spark discharge for igniting an air-fuel mixture, wherein said ignition coil includes a coil body portion further including a primary winding, a secondary winding wound concentric with said primary winding, and a coil core; and a cylindrical protection metal pipe for protecting said coil body portion by receiving said coil body portion in its own inside, wherein said protection metal pipe is formed as a plughole pipe fixed to a cylinder head.

6. The internal combustion engine ignition system according to claim 5, wherein:

said spark plug includes a center electrode inserted in a front end side of an axial hole of an insulator, a metal shell disposed so as to form a collar portion having a plug bearing surface touching said cylinder head directly or indirectly through another member and so as to surround a radial circumference of said insulator, and a ground electrode coupled to said metal shell so that a spark discharge is generated between said ground electrode and said center electrode; and said spark plug is fixed to said cylinder head by said protection metal pipe of said ignition coil while said plug bearing surface of said metal shell is pressed against said cylinder head.

7. The internal combustion engine ignition system according to claim 5, wherein said ignition system further comprises ionic current detection means for detecting an ionic current flowing in a closed loop formed by said spark plug and said secondary winding after combustion of an air-fuel mixture.

8. The internal combustion engine ignition system according to claim 5, wherein said coil body portion and said protection metal pipe are integrated with each other so that they cannot rotate around an axis.

9. The internal combustion engine ignition system according to claim 5, wherein the inside of said protection metal pipe is filled with an insulating material.

10. The internal combustion engine ignition system according to claim 5, wherein said protection metal pipe has a position regulating portion for positioning said coil body portion in an axial direction in its own inside.

* * * * *